US009836911B2

(12) United States Patent
Willis

(10) Patent No.: US 9,836,911 B2
(45) Date of Patent: Dec. 5, 2017

(54) GAMING SYSTEM AND A METHOD OF GAMING

(75) Inventor: John Vincent Willis, Annandale (AU)

(73) Assignee: Aristocrat Technologies Australia Pty Limited (AU)

( * ) Notice: Subject to any disclaimer, the term of this patent is extended or adjusted under 35 U.S.C. 154(b) by 868 days.

(21) Appl. No.: 11/970,365

(22) Filed: Jan. 7, 2008

(65) Prior Publication Data

US 2008/0167119 A1 Jul. 10, 2008

(30) Foreign Application Priority Data

Jan. 9, 2007 (AU) ..... 2007900083

(51) Int. Cl.
*G07F 17/32* (2006.01)

(52) U.S. Cl.
CPC ..... *G07F 17/32* (2013.01); *G07F 17/3244* (2013.01); *G07F 17/3258* (2013.01)

(58) Field of Classification Search
USPC ..... 463/16, 25, 27, 42
See application file for complete search history.

(56) References Cited

U.S. PATENT DOCUMENTS

| | | | | |
|---|---|---|---|---|
| 4,856,787 | A * | 8/1989 | Itkis | 273/237 |
| 5,116,055 | A | 5/1992 | Tracy | |
| 5,885,158 | A | 3/1999 | Torango et al. | |
| 5,951,397 | A * | 9/1999 | Dickinson | 463/36 |
| 6,241,608 | B1 | 6/2001 | Torango | |
| 6,592,460 | B2 | 7/2003 | Torango | |
| 6,652,378 | B2 | 11/2003 | Cannon et al. | |
| 6,860,810 | B2 * | 3/2005 | Cannon et al. | 463/20 |
| 7,077,746 | B2 | 7/2006 | Torango | |
| 7,384,336 | B2 | 6/2008 | Torango | |
| 7,699,699 | B2 * | 4/2010 | Gilliland et al. | 463/20 |
| 7,862,427 | B2 | 1/2011 | Nguyen et al. | |
| 8,602,882 | B2 | 12/2013 | Nguyen et al. | |
| 2003/0130029 | A1 * | 7/2003 | Crumby | 463/20 |
| 2003/0139214 | A1 | 7/2003 | Wolf et al. | |
| 2005/0096130 | A1 * | 5/2005 | Mullins | G07F 17/32 463/27 |
| 2005/0107153 | A1 * | 5/2005 | Jubinville et al. | 463/18 |
| 2005/0239542 | A1 * | 10/2005 | Olsen | 463/27 |
| 2006/0089190 | A1 * | 4/2006 | Bryant et al. | 463/20 |
| 2006/0148547 | A1 * | 7/2006 | Montgomery et al. | 463/13 |
| 2007/0218975 | A1 * | 9/2007 | Iddings | G07F 17/32 463/25 |
| 2008/0039175 | A1 * | 2/2008 | Tessmer et al. | 463/20 |
| 2008/0113738 | A1 * | 5/2008 | Vallejo et al. | 463/20 |

FOREIGN PATENT DOCUMENTS

| | | | |
|---|---|---|---|
| AU | 2004203291 | A1 | 2/2005 |
| WO | 2006037165 | A1 | 4/2006 |

* cited by examiner

*Primary Examiner* — Jay Liddle
(74) *Attorney, Agent, or Firm* — McAndrews, Held & Malloy, Ltd.

(57) ABSTRACT

A gaming system is disclosed which comprises a game controller arranged to selectively implement one of a plurality of games in response to player input, and a denomination selector arranged to facilitate selection by a player of a bet denomination, each game being associated with at least one bet denomination, and wherein at least one bet denomination of at least one of the games is different to at least one bet denomination of at least one of the other games. A corresponding method is also disclosed.

12 Claims, 6 Drawing Sheets

GAMING SYSTEM AND A METHOD OF GAMING

CROSS REFERENCE TO RELATED APPLICATIONS

This application claims priority to Australian Patent Application No. AU2007900083, having an international filing date of Jan. 9, 2007, entitled "A Gaming System and a Method of Gaming", which is hereby incorporated by reference herein in its entirety.

FIELD OF THE INVENTION

The present invention relates to a gaming system and to a method of gaming.

BACKGROUND OF THE INVENTION

It is known to provide a gaming system which comprises a game controller arranged to implement any one of a plurality of games, the game implemented by the gaming system being selectable by a player However, while such gaming systems provide users with enjoyment, a need exists for alternative gaming systems in order to maintain or increase player enjoyment.

SUMMARY OF THE INVENTION

In accordance with a first aspect of the present invention, there is provided a gaming system comprising:

a game controller arranged to selectively implement one of a plurality of games in response to player input; and a denomination selector arranged to facilitate selection by a player of a bet denomination, each game being associated with at least one bet denomination, and wherein at least one bet denomination of at least one of the games is different to at least one bet denomination of at least one of the other games.

In accordance with a second aspect of the present invention, there is provided a gaming system comprising:

a game controller arranged to selectively implement one of a plurality of games in response to a player selection;

wherein the gaming system is arranged to allow independent specification of denominations available to a player for at least two games of the plurality of games.

In one embodiment, the gaming system further comprises a denomination selector arranged to facilitate selection by a player of a bet denomination.

The bet denomination(s) associated with a game may be different to the bet denomination(s) associated with all of the other games.

In one arrangement, at least one game has a plurality of associated bet denominations.

In one variation, at least two games have at least one bet denomination of the same amount.

The gaming system may comprise a touch screen display arranged to facilitate selection by a player of a game and a bet denomination by touching the display.

The gaming system may comprise a prize meter arranged to maintain a record of a special prize value associated with at least some of the games, wherein the special prize value changes in proportion to the credit value.

The gaming system may be implemented as a stand alone gaming machine or across a network.

In an arrangement wherein the gaming system is implemented across a network, one or more progressive meters shared with multiple networked player operable gaming machines may be provided.

In one variation, multiple bonus prizes may be provided with each bonus prize being associated with a particular denomination.

In accordance with a third aspect of the present invention, there is provided a method of gaming comprising:

facilitating selection by a player of a game from a plurality of games, each game being associated with at least one bet denomination, and the at least one bet denomination of at least one of the games being different to at least one bet denomination of at least one of the other games; and implementing the selected game.

In accordance with a fourth aspect of the present invention, there is provided a computer program arranged when loaded into a computer to instruct the computer to operate in accordance with a gaming system comprising:

a game controller arranged to selectively implement one of a plurality of games in response to player input; and a denomination selector arranged to facilitate selection by a player of a bet denomination, each game being associated with at least one bet denomination, and wherein at least one bet denomination of at least one of the games is different to at least one bet denomination of at least one of the other games.

In accordance with a fifth aspect of the present invention, there is provided a computer readable medium having computer readable program code embodied therein for causing a computer to operate in accordance with a gaming system comprising:

a game controller arranged to selectively implement one of a plurality of games in response to player input; and a denomination selector arranged to facilitate selection by a player of a bet denomination, each game being associated with at least one bet denomination, and wherein at least one bet denomination of at least one of the games is different to at least one bet denomination of at least one of the other games.

In accordance with a sixth aspect of the present invention, there is provided data signal having computer readable program code embodied therein for causing a computer to operate in accordance with a gaming system comprising:

a game controller arranged to selectively implement one of a plurality of games in response to player input; and a denomination selector arranged to facilitate selection by a player of a bet denomination, each game being associated with at least one bet denomination, and wherein at least one bet denomination of at least one of the games is different to at least one bet denomination of at least one of the other games.

BRIEF DESCRIPTION OF THE DRAWINGS

Certain embodiments of the present invention will now be described, by way of example only, with reference to the accompanying drawings, in which.

DESCRIPTION OF CERTAIN EMBODIMENTS OF THE INVENTION

Figure 1:
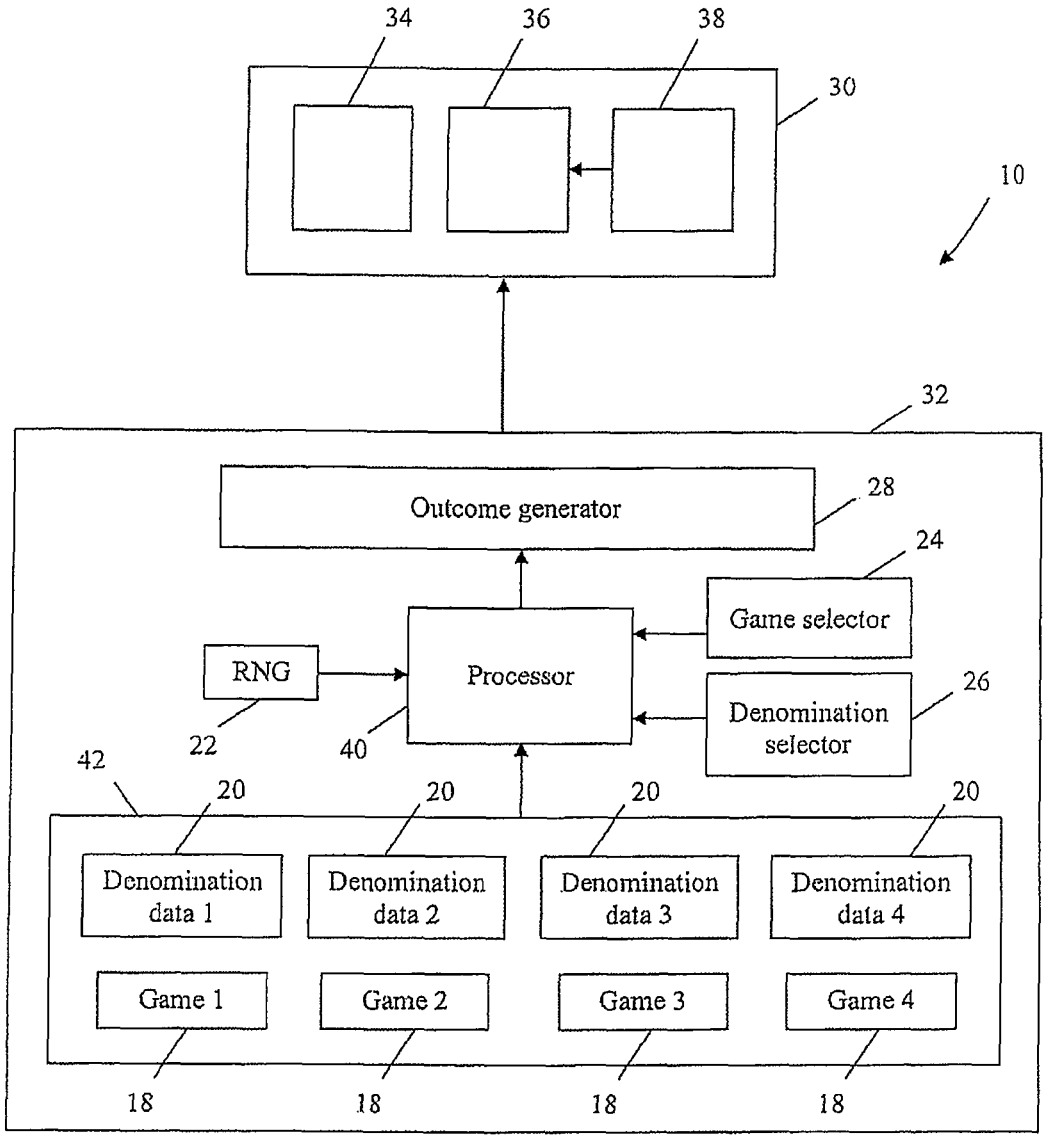
FIG. 1 is a schematic block diagram of functional components of a gaming system in accordance with an embodiment of the present invention.

Referring to FIG. 1 of the drawings, there is shown a schematic block diagram of a gaming system 10 arranged to implement a probabilistic game selected from a plurality of probabilistic games by a player. Typical probabilistic games include games of the type wherein several symbols from a set of symbols are randomly displayed, and a game outcome is determined on the basis of the displayed symbols.

With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system 10 operates such that each selectable game has one or more associated bet denominations with at least one bet denomination of at least one of the games being different to at least one bet denomination of at least one of the other games.

The gaming system 10 is configured so as to allow independent specification of denominations available to a player for at least two available games so that it is possible to provide a player with the option of selecting a game and selecting a bet denomination from specific denominations uniquely assigned to the game.

During use, the gaming system 10 operates such that a player is provided with the option of selecting a game, and where the selected game has more than one associated bet denomination, with the option of selecting the desired bet denomination for the game.

The bet denominations available for a game may be different to the denominations available for at least one other game such that at least 2 games have no bet denominations in common. Each game may have one or more associated bet denominations, and at least two games may have at least one bet denomination of the same amount.

The gaming system 10 comprises a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 which may include buttons arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

The memory 42 is arranged to store game instruction data 18 indicative of a plurality of games which may be implemented by the gaming system.

The memory 42 is also arranged to store bet denomination data 20 indicative of one or more bet denominations associated with each of the plurality of games. It will be understood that each game has one or more associated bet denominations with the bet denomination(s) associated with a game being independent of the denomination(s) associated with the other games. In this way, it is possible to provide for independent selection of a game and bet denomination by a player.

The game controller 32 further includes a random number generator 22 usable by the processor 40 during implementation of a probabilistic game.

It will be appreciated that the random number generator 22 may be of a type which is arranged to generate pseudo random numbers based on a seed number, and that in this specification the term "random" will be understood accordingly to mean truly random or pseudo random.

The game controller 32 also comprises a game selector 24 arranged, in this example in association with the display 36 and/or the game play mechanism 38, to facilitate selection by a player of a game to be implemented by the gaming system 10, and a denomination selector 26 arranged, in this example in association with the display 36 and/or the game play mechanism 38, to facilitate selection by a player of a bet denomination to be used during implementation of the selected game.

The game controller 32 also comprises an outcome generator 28 which in accordance with the game instructions 18 determines game outcomes during implementation of a selected game.

In the embodiments described below, the game selector 24, the denomination selector 26, and the outcome generator 28 are at least partly implemented using the processor 40 and associated software, although it will be understood that other implementations are envisaged.

The gaming system 10 can take a number of different forms.

In a first form, a stand alone gaming machine is provided wherein all or most components required for implementing a selected game are present in a player operable gaming machine.

In a second form, a distributed architecture is provided wherein some of the components required for implementing a selected game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the selected game being played, operating conditions, and so on. Other variations will be apparent to persons skilled in the art.

Figure 2:
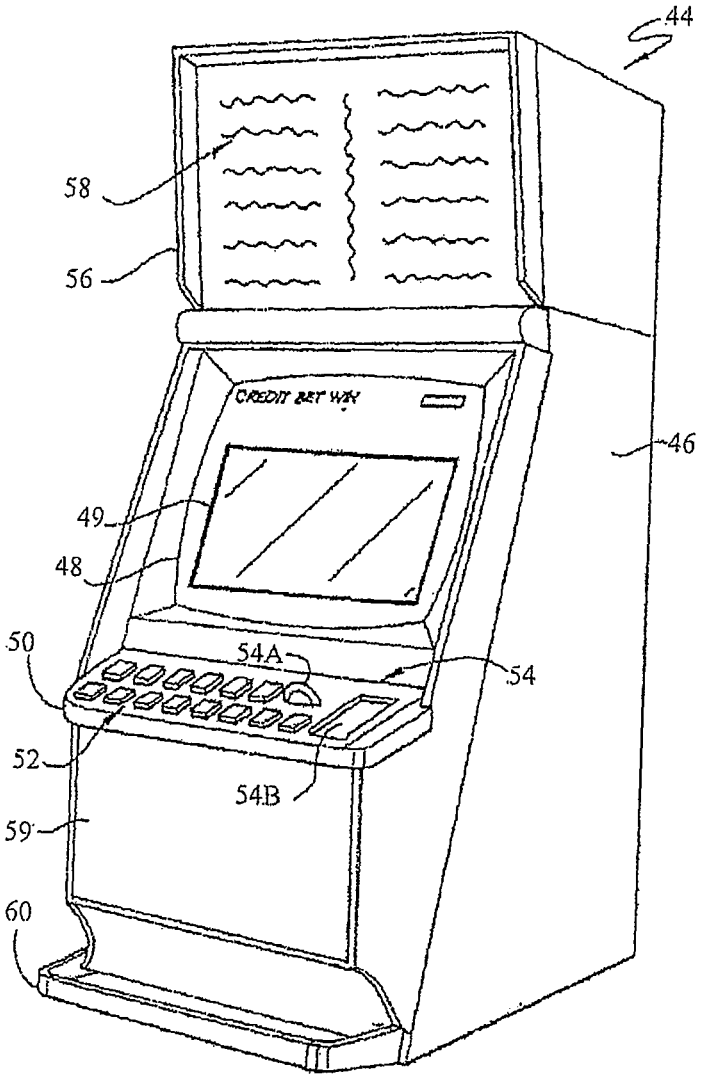
FIG. 2 is a diagrammatic representation of a gaming system in accordance with an embodiment of the present invention with the gaming system implemented in the form of a stand alone gaming machine.

A gaming system in the form of a stand alone gaming machine 44 is illustrated in FIG. 2. The gaming machine 44 includes a console 46 having a display 48 on which is displayed representations of a game 49 that can be played by a player. A mid-trim 50 of the gaming machine 44 houses a bank of buttons 52 for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 46. A coin tray 60 is mounted beneath the front panel 59 for dispensing cash payouts from the gaming machine 44.

The display 48 is in the form of a video display unit, particularly a cathode ray tube screen device. Alternatively, the display 48 may be a liquid crystal display, plasma screen, or any other suitable video display unit. The top box 56 may also include a display, for example a video display unit, which may be of the same type as the display 48, or of a different type.

The display 48 in this example is arranged to display representations of several games which are selectable by a player, a selected game being implemented by the gaming machine 44.

The games which are implementable by the gaming machine 44 may be of a type including one or more physical or virtual reels. Such gaming machines including actual rotatable reels are commonly termed stepper machines.

A stepper machine typically has a separate motor for each reel, and the game controller of such a gaming machine has a stop determining function that determines the stop position for each reel. For example, if there are five reels, each having twenty symbols, the stop determining function might determine that the stop positions are positions 3, 13, 7, 9 and 17. When a reel stops, the symbols will be in one of a plurality of possible symbol positions for that reel relative to the stop position.

Figure 3:
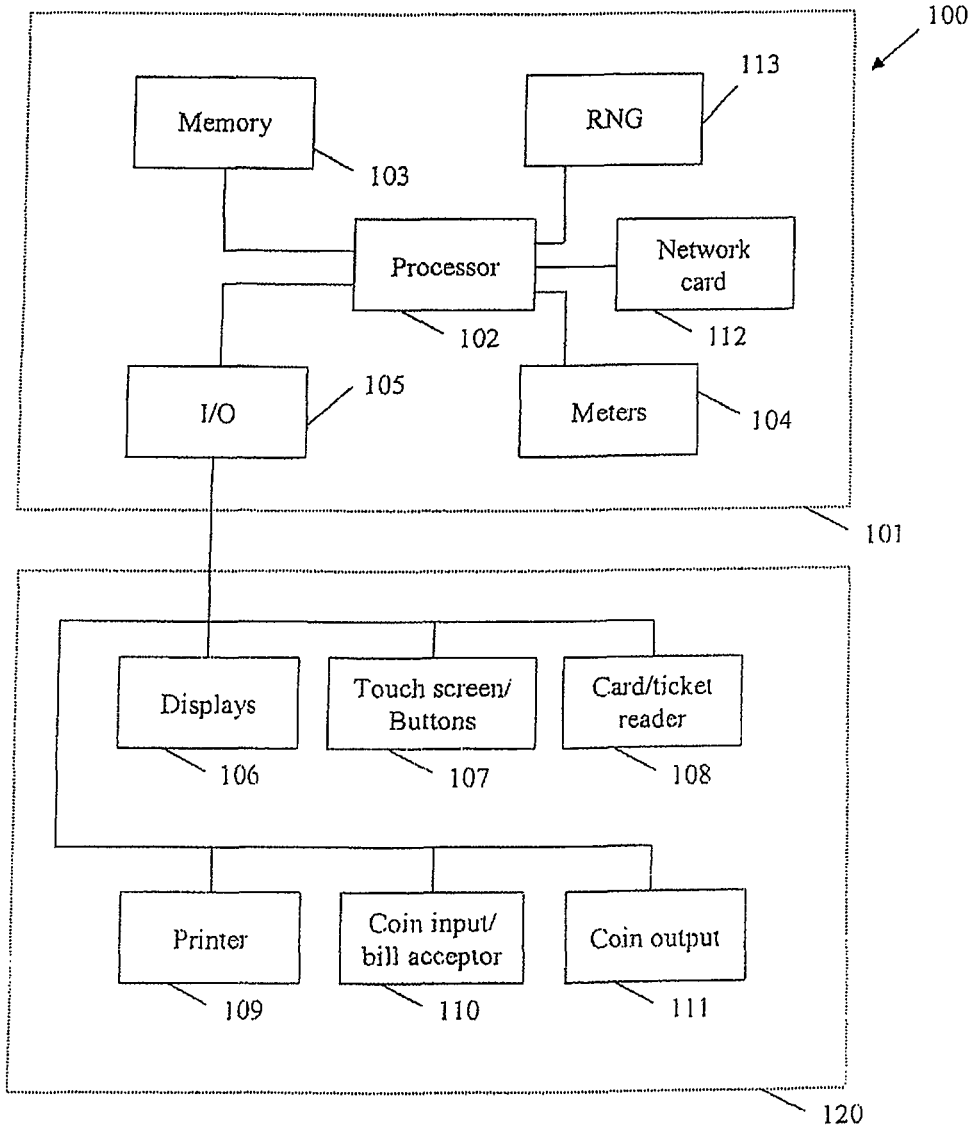
FIG. 3 is a schematic block diagram of operative components of the gaming machine shown in FIG. 2.

FIG. 3 shows a block diagram of operative components of a typical gaming machine 100 which may be the same as or different to the gaming machine 40 shown in FIG. 2.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 4:
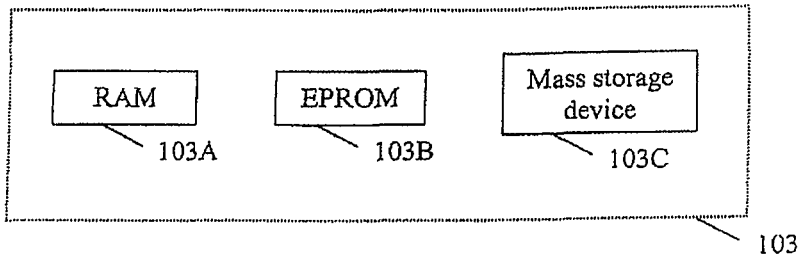
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

The hardware meters 104 may include a progressive meter which is contributed to by at least some of the available games, the progressive meter incrementing in proportion to the credit value of the bet per game. For example, the progressive meter may maintain a record of a bonus or jackpot prize associated with all of the games and the gaming system 100 arranged such that a player of any of the games may receive the bonus or jackpot prize by satisfying a predetermined condition defined for the games.

Figure 5:
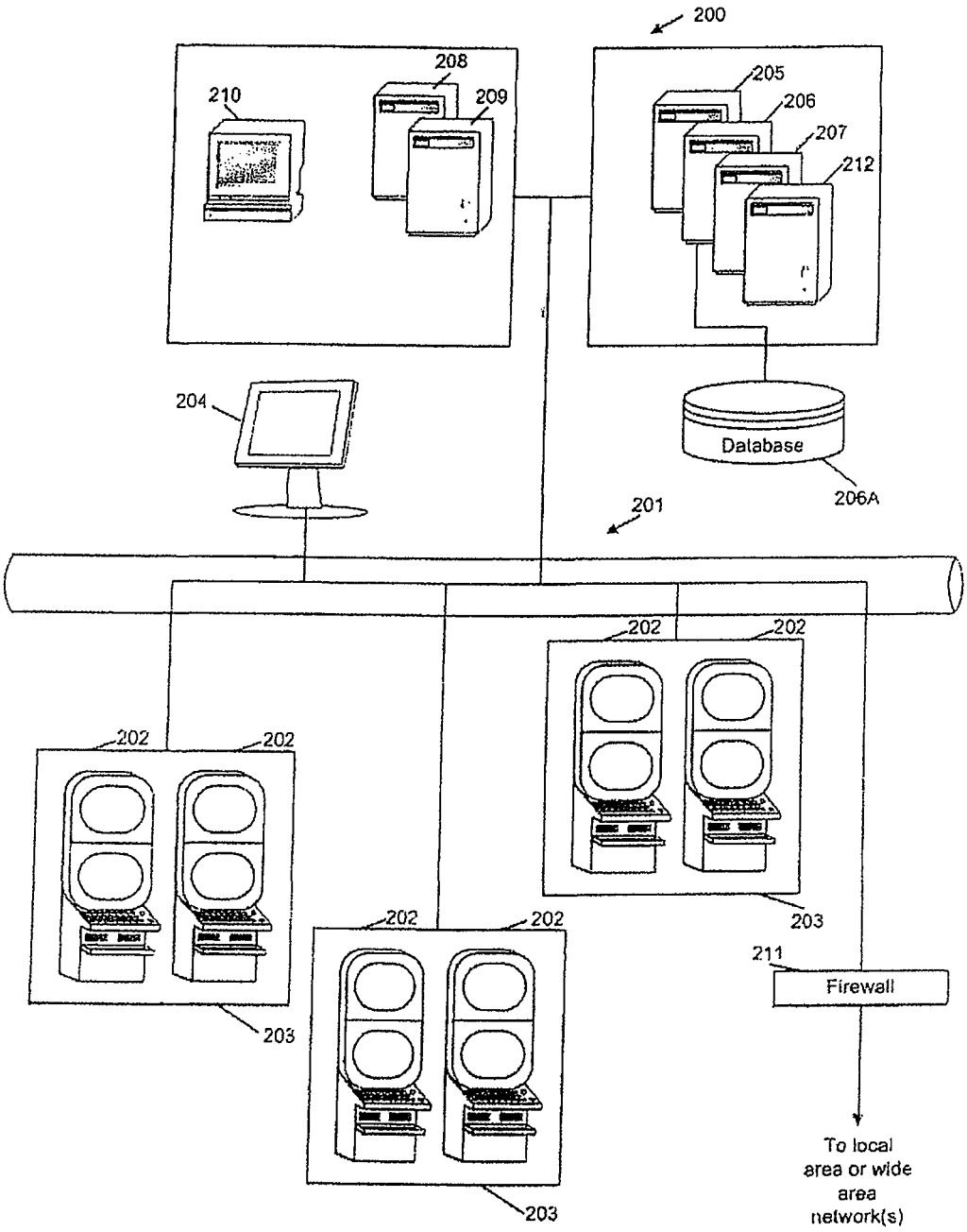
FIG. 5 is a schematic diagram of a gaming system in accordance with an alternative embodiment of the present invention with the gaming system implemented over a network.

In an alternative arrangement, instead of providing each of the gaming systems 100 with a progressive meter, one or more shared progressive meters may be provided, for example as part of the jackpot server 207 of the networked gaming system 200 shown in FIG. 5.

In one variation, multiple bonus or jackpot prizes may be provided with each bonus or jackpot prize being associated with a particular denomination. In this way, each denomination has an associated jackpot.

In the example shown in FIG. 3, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 44 or over a network 201, provides a player with the option to select a game from a plurality of games, and to select the bet denomination to be used during implementation of the selected game.

Examples of specific implementations of the gaming system will now be described in relation to a stand alone gaming machine 44 although it will be understood that implementation may also be carried out using other gaming system architectures such as a network architecture of the type shown in FIG. 5.

Figure 6:
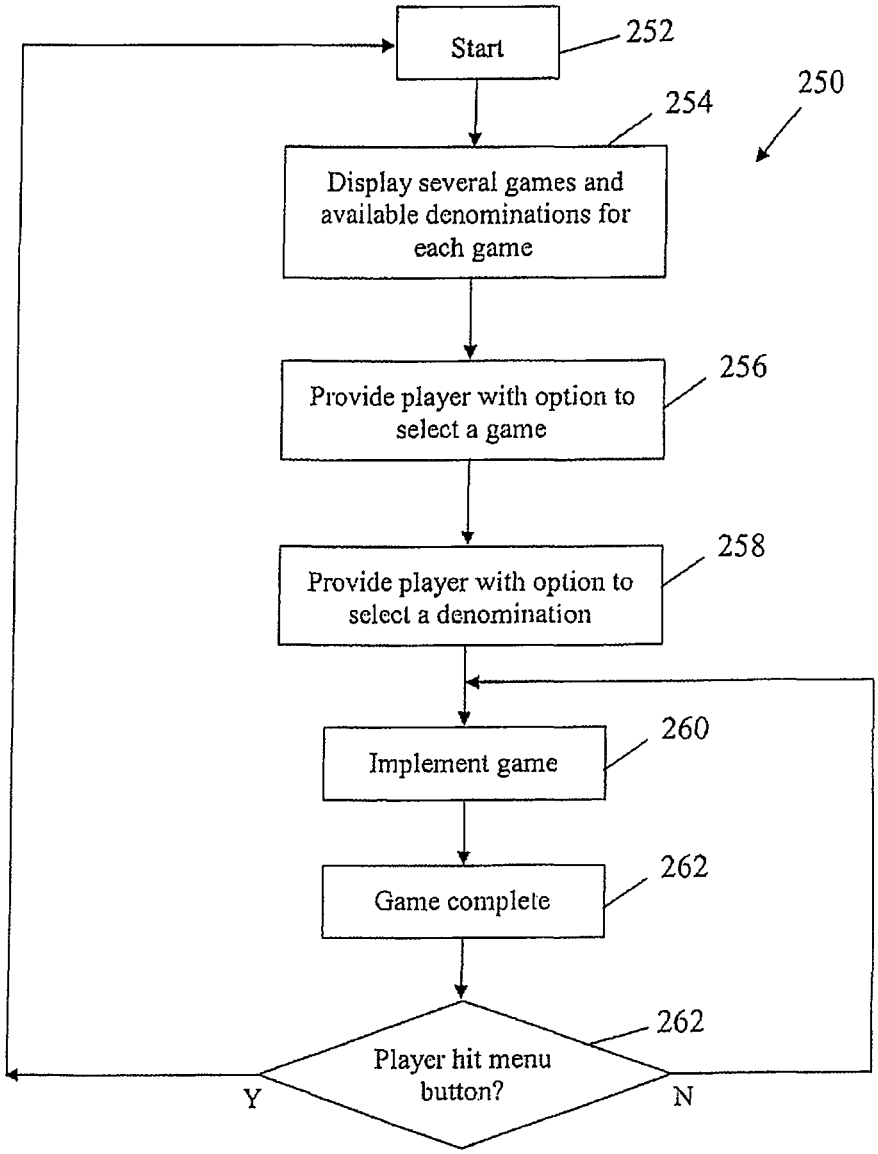
FIG. 6 is a flow diagram illustrating game play of a gaming system in accordance with an embodiment of the present invention.

A specific example will now be described in relation to flow diagram 250 shown in FIG. 6 which illustrates steps 252 to 262 of a method of gaming implemented by the gaming system according to the present embodiment.

Figure 7:
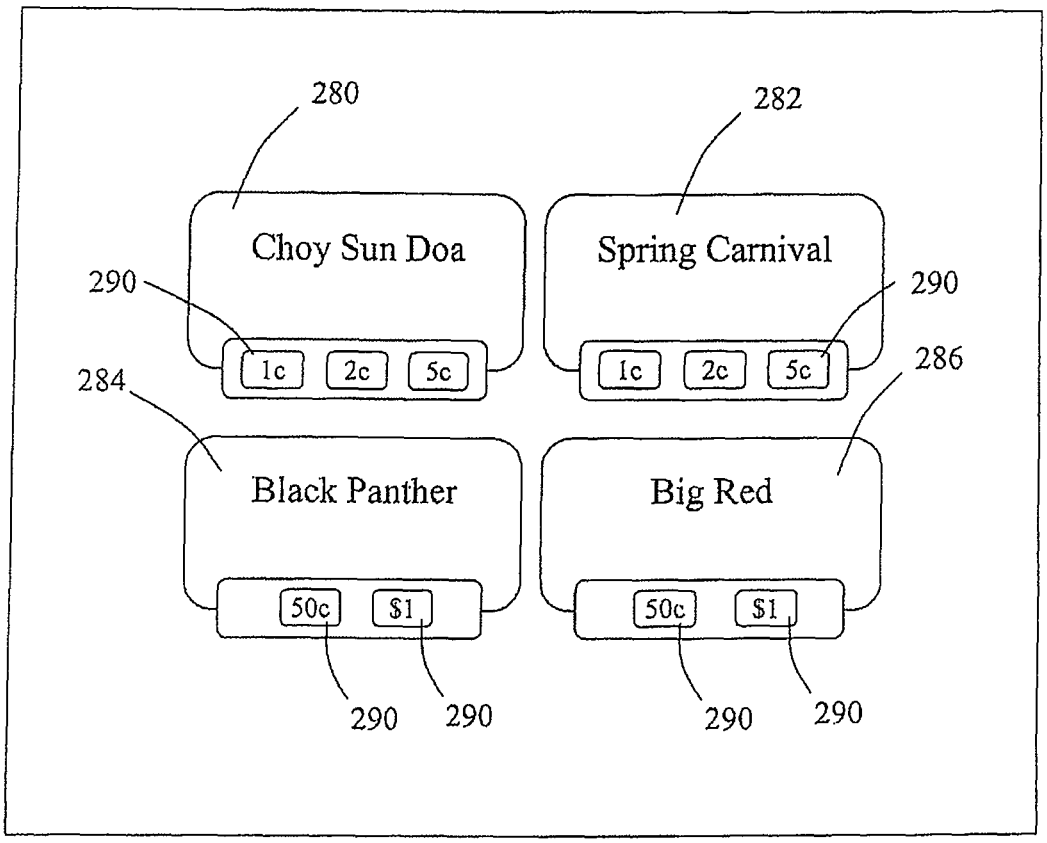
FIG. 7 is a diagrammatic representation of an example screen displayed by a gaming system in accordance with an embodiment of the present invention during implementation of a game.

In this example, four selectable games are provided and shown on the display 48, as shown in FIG. 7. Each of the games has an associated graphical identifier (not shown) including indicia representative of the game disposed in game regions 280, 282, 284, 286.

In this example, the display 48 is a touch screen display and a game is selectable by a player by touching a denomination identifier 290 associated with the desired denomination amount and the desired game.

The gaming system then implements the selected game using the selected bet denomination.

It will be understood that other variations are possible. For example, the gaming system may first require a player to select a desired game, then subsequently require a player to select a desired denomination, or alternatively the gaming system may first require a player to select a desired denomination, then subsequently require a player to select a desired game.

In the present example, each game has multiple available bet denominations with the available denominations for two games being the same and the available denominations for the remaining two games also being the same. However, it will be understood that other variations are possible. For example, one bet denomination may be available for each game with at least some of the denominations being different, the available bet denominations for a game may be different to the available denominations for all of the other games, or the number of denominations for the games may be different.

Modifications and variations as would be apparent to a skilled addressee are deemed to be within the scope of the present invention.

The invention claimed is:

1. A gaming system comprising:

a game controller configured to selectively implement one game of a plurality of games in response to player input;

a manually operable player interface in data communication with the game controller, the player interface comprising a credit input mechanism, the credit input mechanism configured for player interaction to receive a physical item representing a monetary value for receiving a credit input and establishing a credit balance, the credit balance being increasable and decreasable based at least on wagering activity, a hardware meter configured to monitor the credit input having been provided by the credit input mechanism;

and wherein said player interface is configured to place a wager in accord with said credit balance, said player interface includes a denomination selector configured to receive a first selection by a player of a bet denomination of the plurality of games being associated with a group of bet denominations, at least one group of bet denominations of at least one of the plurality of games being different than at least one group of bet denominations of at least one other game of the plurality of games, and at least one group of bet denominations of at least one of the plurality of games being the same as at least one group of bet denominations of at least one other game of the plurality of games; and wherein said player interface includes a game selector configured to receive a second selection by a player of said one game following said first selection of a bet denomination;

wherein the gaming system provides a plurality of jackpots, each jackpot being associated with a particular bet denomination such that the same bet denominations from at least two of the plurality of games contribute to the same associated jackpot; and wherein in response to receiving said first selection of a bet denomination through said denomination selector and said second selection of said one game, and in accord with the placed wager, said game controller implements said one game; and a payout mechanism configured to payout value in accordance with the credit balance.

2. A gaming system as claimed in claim 1, further comprising a touch screen display configured to facilitate selection by a player of a game and a bet denomination by touching the display.

3. A gaming system as claimed in claim 1, and wherein a bet in accordance with the at least one bet denomination is wagerable, and further comprising a prize meter configured to maintain a record of a special prize value associated with at least some of the plurality of games, and wherein the special prize value changes in proportion to the bet.

4. A gaming system as claimed in claim 3, wherein multiple special prizes are provided, each special prize being associated with a particular denomination.

5. A gaming system as claimed in claim 1, wherein the gaming system is implemented as a standalone gaming machine.

6. A gaming system as claimed in claim 1, wherein the gaming system is implemented across a network.

7. A gaming system comprising:

a game controller configured to selectively implement one game of a plurality of games in response to a player selection;

a manually operable player_interface in data communication with the game controller, the player interface comprising a credit input mechanism configured for player interaction to receive a physical item representing a monetary value for receiving a credit input and establishing a credit balance, the credit balance being increasable and decreasable based at least on wagering activity, a hardware meter configured to monitor the credit input provided by the credit input mechanism, the player interface configured for placement of a wager in accord with said credit balance and to allow independent specification of denominations available to a player for at least two games of the plurality of games, said interface being further configured to receive a first selection by a player of a bet denomination, wherein each of the plurality of games being associated with a group of bet denominations, at least one group of bet denominations of at least one of the plurality of games being different than at least one group of bet denominations of at least one other game of the plurality of games, and at least one group of bet denominations of at least one of the plurality of games being the same as at least one group of bet denominations of at least one other game of the plurality of games; and wherein said player interface includes a game selector configured to receive a second selection by a player of a one game following said first selection of a bet denomination;

wherein the gaming system provides a plurality of jackpots, each jackpot being associated with a particular bet denomination such that the same bet denomination from at least two of the plurality of games contribute to the same associated jackpot; and wherein in response to receiving said first selection of a bet denomination through said interface and said second selection of said one game, and in accord with the placed wager, said game controller is configured to implement said one game;

a payout mechanism configured to payout value in accordance with the credit balance.

8. A method of gaming for use with a gaming system having a game controller in data communication with a manually operable player interface, the interface comprising a credit input mechanism configured for player interaction to receive a physical item representing a monetary value for receiving a credit input and establishing a credit balance, the credit balance being increasable and decreasable based at least on wagering activity, a hardware meter configured to monitor the credit input having been provided by the credit input mechanism,_the method comprising:

implementing at least one game of a plurality of games via the game controller, each of said plurality of games being associated with a group of bet denominations, at least one group of bet denominations of at least one game of the plurality of games being different than at least one group of bet denominations of at least one other game of the plurality of games, and at least one group of bet denominations of at least one game of the plurality of games being the same as at least one group of bet denominations of at least one other game of the plurality of games;

receiving, via said interface, a wager in accord with said credit balance, said wager comprising a first selection by a player of a bet denomination;

receiving, via said interface, and a second selection by a player of a game following said first selection of a bet denomination; and providing a plurality of jackpots, each jackpot being associated with a particular bet denomination such that the same bet denomination from at least two of the plurality of games contribute to the same associated jackpot; and in response to receiving said first selection of a bet denomination_and said second selection of said one game, and in accord with the wager, implementing said one game; and a payout mechanism configured to payout value in accordance with the credit balance.

9. A method as claimed in claim 8, further comprising providing a touch screen and facilitating selection by a player of a bet denomination using the touch screen.

10. A method as claimed in claim 8, and wherein a bet in accordance with the at least one bet denomination is wagerable, and further comprising maintaining a record of a special prize value associated with at least some of the games, wherein the special prize value changes in proportion to the bet.

11. A method as claimed in claim 10, comprising providing multiple special prizes, each special prize being associated with a particular denomination.

12. A method of gaming for use with a gaming system having a game controller configured to selectively implement one game of a plurality of games in response to player input, a manually operable player interface in data communication with the game controller, and a hardware meter, the player interface comprising, a denomination selector, a game selector, and a credit input mechanism configured for player interaction to receive_a physical item representing a monetary value for establishing a credit balance, the credit balance being increasable and decreasable based at least on wagering activity, the hardware meter configured to monitor to credit input having been provided by the credit input mechanism; the method comprising:

specifying independent denominations available for at least two games of the plurality of games, wherein each of the plurality of games being associated with a group of bet denominations, at least one group of bet denominations of at least one of the plurality of games being different than at least one group of bet denominations of at least one other game of the plurality of games, and at least one group of bet denominations of at least one of the plurality of games being the same as at least one group of bet denominations of at least one other game of the plurality of games;

providing a plurality of jackpots, each jackpot being associated with a particular bet denomination such that the same bet denomination from at least two of the plurality of games contribute to the same associated jackpot; and receiving, via the player interface, selection of a bet denomination via the denomination selector followed by selection of a game via the game selector;

selectively implementing one of the plurality of games in response to said selected bet denomination and said selected game.

* * * * *